US006932225B2

(12) United States Patent
Rowe

(10) Patent No.: US 6,932,225 B2
(45) Date of Patent: Aug. 23, 2005

(54) STORAGE SYSTEM

(75) Inventor: Tony Rowe, Twickenham (GB)

(73) Assignee: Newell Limited, Tyne and Wear (GB)

( * ) Notice: Subject to any disclaimer, the term of this patent is extended or adjusted under 35 U.S.C. 154(b) by 5 days.

(21) Appl. No.: 10/299,157

(22) Filed: Nov. 19, 2002

(65) Prior Publication Data

US 2003/0234231 A1 Dec. 25, 2003

(30) Foreign Application Priority Data

Jun. 21, 2002 (GB) ..... 0214400

(51) Int. Cl.[7] ..... A47F 5/08
(52) U.S. Cl. ..... 211/90.02
(58) Field of Search ..... 211/90.02, 90.04, 211/103, 94.01; 248/239, 340, 225.11, 225.21

(56) References Cited

U.S. PATENT DOCUMENTS

| | | | | | |
|---|---|---|---|---|---|
| 3,175,243 | A | * | 3/1965 | Weber | 211/94.01 |
| 4,048,768 | A | | 9/1977 | Good | |
| 4,138,019 | A | * | 2/1979 | Smith | 211/87.01 |
| 4,898,286 | A | * | 2/1990 | Orlandi | 211/187 |
| 5,110,080 | A | | 5/1992 | Rieman | |
| 5,305,898 | A | * | 4/1994 | Merl | 211/103 |
| 5,332,108 | A | * | 7/1994 | Blass | 211/90.02 |
| 5,472,103 | A | * | 12/1995 | Merl | 211/90.02 |
| 5,472,167 | A | * | 12/1995 | Shillington et al. | 211/94.01 |
| 5,485,932 | A | * | 1/1996 | Romm et al. | 211/103 |
| 5,988,576 | A | * | 11/1999 | Ehrlich | 248/220.21 |
| 6,044,986 | A | * | 4/2000 | Wood | 211/90.02 |
| 6,109,461 | A | * | 8/2000 | Kluge et al. | 211/103 |
| 6,179,136 | B1 | * | 1/2001 | Kluge et al. | 211/103 |
| 6,520,355 | B1 | * | 2/2003 | Pritchard et al. | 211/94.01 |
| 6,540,093 | B1 | * | 4/2003 | Shumway | 211/90.02 |

FOREIGN PATENT DOCUMENTS

| | | |
|---|---|---|
| EP | 0611534 | 8/1994 |
| GB | 0485019 | 5/1938 |
| SE | 504960 | 6/1997 |
| WO | WO 02/26084 | 4/2002 |

* cited by examiner

*Primary Examiner*—Hugh B. Thompson, II
*Assistant Examiner*—Sarah Purol
(74) *Attorney, Agent, or Firm*—Carmody & Torrance LLP

(57) ABSTRACT

The storage system is a suspended storage system in which one or more uprights are hung from a crossbar (24) and storage elements such as shelves or cabinets are attached to the uprights (1). Each of the uprights (1) is attached to the crossbar (24) by means of a coupling hook (25) which is removably attached to the end of the upright (1) and removably engages with the crossbar (24). The coupling hook (25) has a hook body (26) with a pair of L-shaped hooks (34) for engagement in the slots in the upright (1) and a grub screw (33) arranged to engage with the interior wall of the upright (1) so as to prevent relative movement of the coupling hook (25) with respect to the upright (1) when attached thereto. With this arrangement of the coupling hook (25), attachment to and removal of the coupling hook (25) from the crossbar (24) does not result in consequential loosening of the attachment of the coupling hook (25) to the upright (1).

14 Claims, 6 Drawing Sheets

STORAGE SYSTEM

BACKGROUND OF THE INVENTION

1. Field of the Invention

The present invention relates to suspended storage systems and in particular, but not exclusively, to modular shelving kits suitable for use for example in the home, in offices, in businesses and as product display shelving in shops.

2. Description of Related Art

Modular shelving systems, which have greatly simplified the installation of either wall-hung or free-standing shelving, have been generally available for a number of years and are popular both for commercial installations and in the DIY market. FIG. 1 illustrates a conventional wall-hung metal shelving system comprising a pair of uprights 1, 2, a pair of brackets 3, 4, one bracket being mounted on each of the two uprights 1, 2, and a shelf 5 secured to the brackets 3, 4. Whilst the uprights 1, 2 and the brackets 3, 4 are generally made of a metal such as steel the shelf 5 is most commonly of wood or a similar artificial composite material. Normally a shelving system would consist of two or more pairs of brackets and an equivalent number of shelves which are mounted on the uprights one above the other with space in between each shelf.

The two uprights 1, 2 are intended for mounting generally vertically and parallel with one another on a wall. Each upright 1, 2 has a substantially U-shaped cross-section such that when it is secured to the wall it defines with the surface of the wall an enclosed channel extending substantially vertically. Each upright 1, 2 includes at least two through holes 6 for receiving wall screws for attaching the uprights to the wall. Each upright 1,2 additionally includes two parallel lines of repeating lozenge-shaped apertures 7 extending the length of the upright and opening to the enclosed channel defined by the upright and the wall.

The brackets 3, 4 are also of generally U-shaped cross-section with each side of the bracket generally describing a right-angled triangle. The two sides of the bracket are joined along their hypotenuse edges and the two other edges of each side of the bracket respectively contact the front surface of an upright and the lower surface of the shelf. Thus, the U-shape of the bracket is deepest adjacent the upright and gradually reduces in size to a point furthest from the upright. Two through holes 8 are provided in the downwardly facing surface of each bracket intermediate its two ends. The through holes 8 are adapted to receive screws 9 for securing the shelf 5 to the bracket, as is described in greater detail below. At the edge of the bracket which contacts the upright, a pair of parallel flat hooks are provided which project outwardly from the edge of the bracket. The hooks are L-shaped and are adapted to be inserted through one pair of lozenge-shaped apertures 7 in the upright and to engage with the upright in this manner.

The shelf 5 is a generally rectangular slab which rests over and is supported by the upwardly facing parallel edges of the two brackets 3, 4. Screws 9 inserted through the apertures 8 in the brackets have to be sufficiently long to extent across the depth of the bracket to the underside of the shelf. The screws are then screwed into the underneath of the shelf to secure the shelf to the brackets and to prevent the shelf 5 from tipping if a force were to be applied to the edge of the shelf furthest from the wall.

Construction of a shelving system of the type described above is relatively easy. As long as the two uprights are secured to the wall vertically, aligned and parallel with one another and the brackets present horizontal upper edges when mounted into the slots of an upright, the individual shelves should be horizontal. Such a shelving system also permits the person constructing the shelving to decide the spacing between adjacent shelves and the shelving system allows for different spacing between adjacent shelves in a series of shelves mounted on the same pair of uprights. However, with such a conventional modular shelving system even small variations in the alignment of the two uprights can make it difficult to securely attach a shelf to a pair of brackets mounted on the uprights and even if the shelf is attached it may not lie horizontal.

To improve alignment of the individual uprights and to simplify construction, suspended shelving systems have been developed in which each of the uprights is suspended from a supporting crossbar or girder. Conventionally, the individual uprights are attached directly to the crossbar by means of angled parallel slots cut into each of the two sides of the upright near to the top end of the upright. These slots engage with an upwardly angled lip projecting outwardly from the bottom edge of the crossbar. In this way the upright is hung from the crossbar through the engagement of the upwardly angled lip into the slots in the upper end of the upright. An example of such a suspended shelving system can be found in U.S. Pat. No. 5,110,080.

An alternative version of the suspended modular shelving system is described in Swedish patent publication No. 9201036-2. This alternative shelving system uses an intermediate coupling member to attach the upright to the crossbar. Again the crossbar includes an upwardly angled lip projecting outwardly from the lower edge of the crossbar and the intermediate coupling member includes parallel downwardly angled slots in each side wall of the coupling member for engagement with the lip on the crossbar. The coupling member also includes first and second pairs of hooks which project outwardly from the rear edges of the coupling member for engagement in two adjacent paired slots of a conventional upright. The hooks are generally L-shaped with the first pair of hooks projecting rearwardly and upwardly and the second pair of hooks projecting rearwardly and downwardly, i.e. the two pairs of hooks are arranged to mirror each other.

One of the disadvantages of the suspended shelving systems described above is that the outwardly projecting lip of the crossbar acts to catch dust and is difficult to clean not only because it is usually positioned high on a wall but also because the uprights attached to the crossbar present barriers to the dust being easily swept away. Also, the structure of the crossbar is unsightly and potentially dangerous having as it does sharp edges sticking out from the wall. Also, the intermediate coupling member uses two adjacent sets of paired slots in the upright which results in there being a trade off between the ease with which the coupling member is attached to the upright and the reliability of that attachment.

The present invention seeks to address the problems encountered with conventional suspended modular shelving systems and seeks to provide an improved suspended modular storage system.

BRIEF SUMMARY OF THE INVENTION

In accordance with the present invention there is provided a storage system comprising a suspension crossbar, at least one upright having a plurality of slots arranged in lines along the length of the upright, one or more brackets for attachment to the at least one upright and at least one storage element for mounting on the one or more brackets, the storage system further comprising a respective coupling device for each of said one or more uprights, the coupling device being adapted to hang the upright from the suspension crossbar, the coupling device comprising a hook body adapted for engagement with the suspension crossbar and a downwardly depending wall from which projects a slot hook adapted for engagement in a slot in the upright, the coupling device further comprising a movable holding member arranged to engage the surface of the upright facing away from the downwardly projecting wall of the coupling device.

With the present invention a simple yet effective suspended storage system is provided which ensures a coupling of each upright to the crossbar which is prevented from falling apart even during attachment and detachment from the crossbar.

Ideally, the movable holding member is in the form of a grub screw mounted in a threaded channel in the coupling device and adapted to engage the inner surface of the upright.

Moreover, the coupling device may additionally include a projecting lug for engagement in a screw hole provided in the upright.

Preferably, with the storage system of the present invention individual brackets may be capable of withstanding a 110 Kg force when attached to an upright.

The storage system of the present invention may be used in combination with shelving elements, baskets, cupboards, cabinets or the like.

In a further aspect, the present invention provides a coupling device for use in a suspended storage system comprising a crossbar, at least one upright, at least one bracket and at least one shelf, the coupling device comprising a hook body adapted for engagement with the crossbar of the storage system and a downwardly depending wall from which projects a slot hook adapted for engagement in a slot in an upright of the storage system, the coupling device further comprising a movable holding member movable towards and away from the surface of the downwardly depending wall from which the slot hook projects.

An embodiment of the present invention will now be described by way of example only with reference to the accompanying drawings, in which:

DETAILED DESCRIPTION OF THE INVENTION

Figure 1:
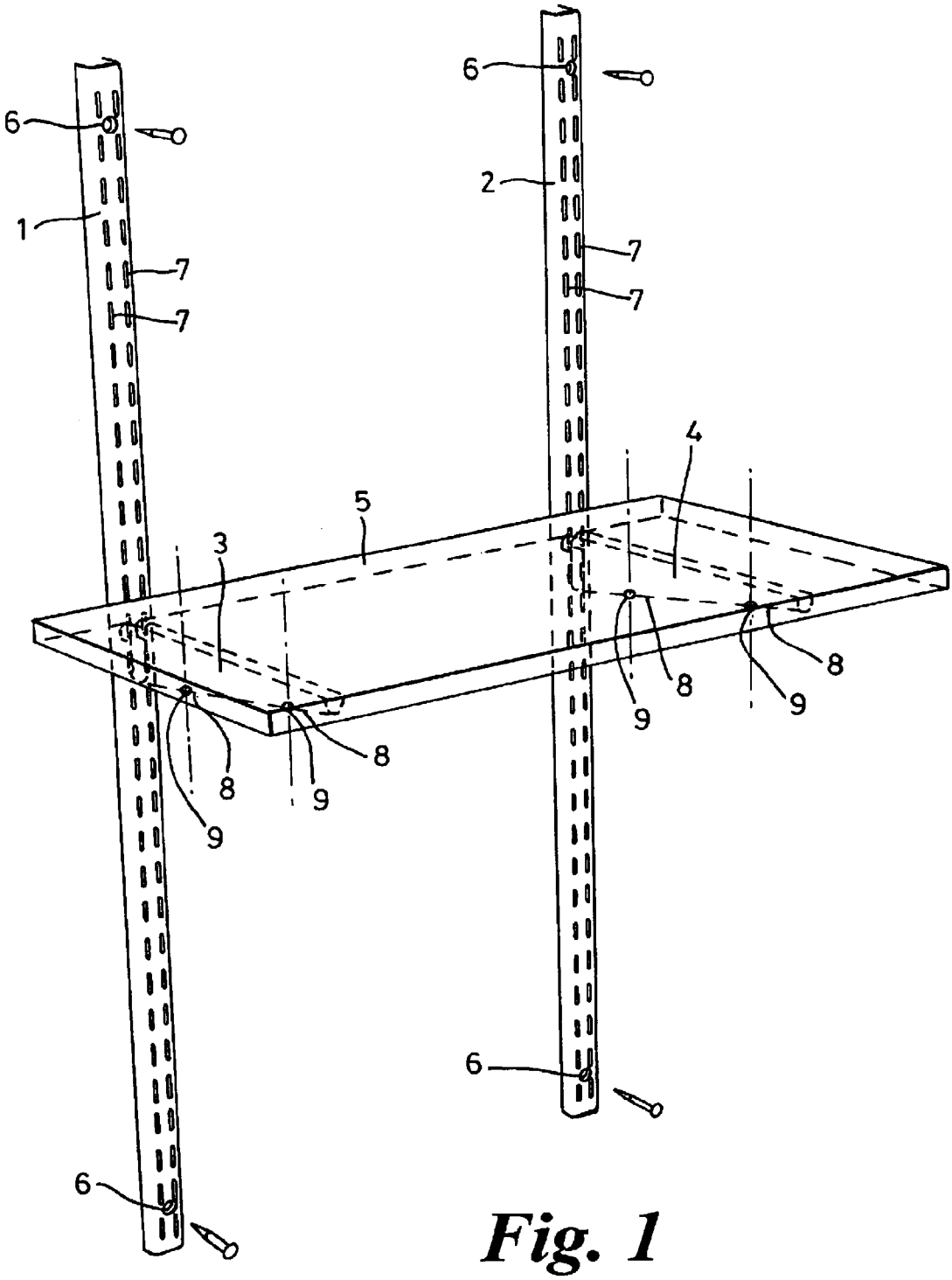
FIG. 1 illustrates a conventional modular shelving system, not in accordance with the present invention.
Figure 2:
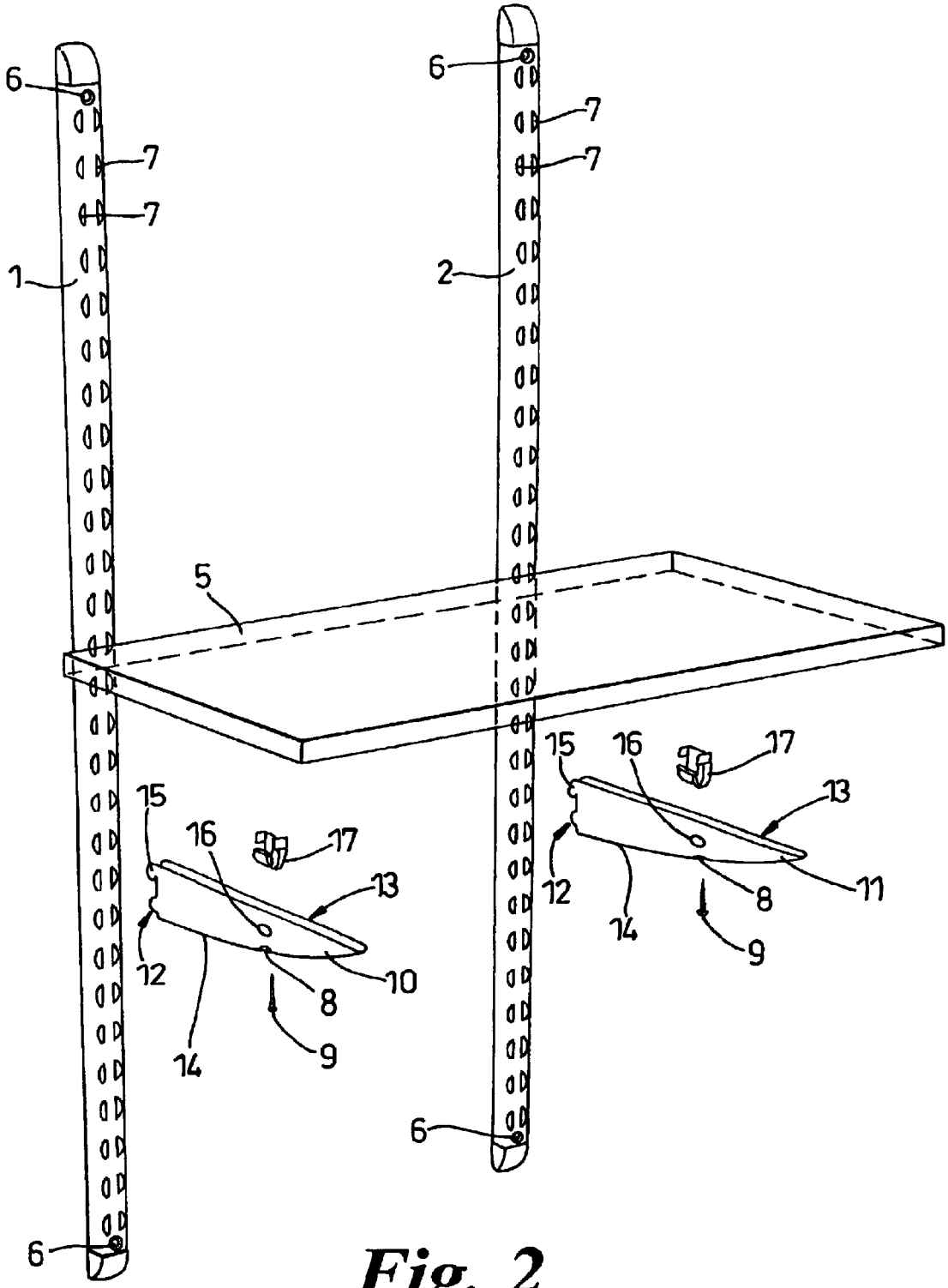
FIG. 2 illustrates in an exploded perspective view an improved wall mounted storage system.
Figure 3:
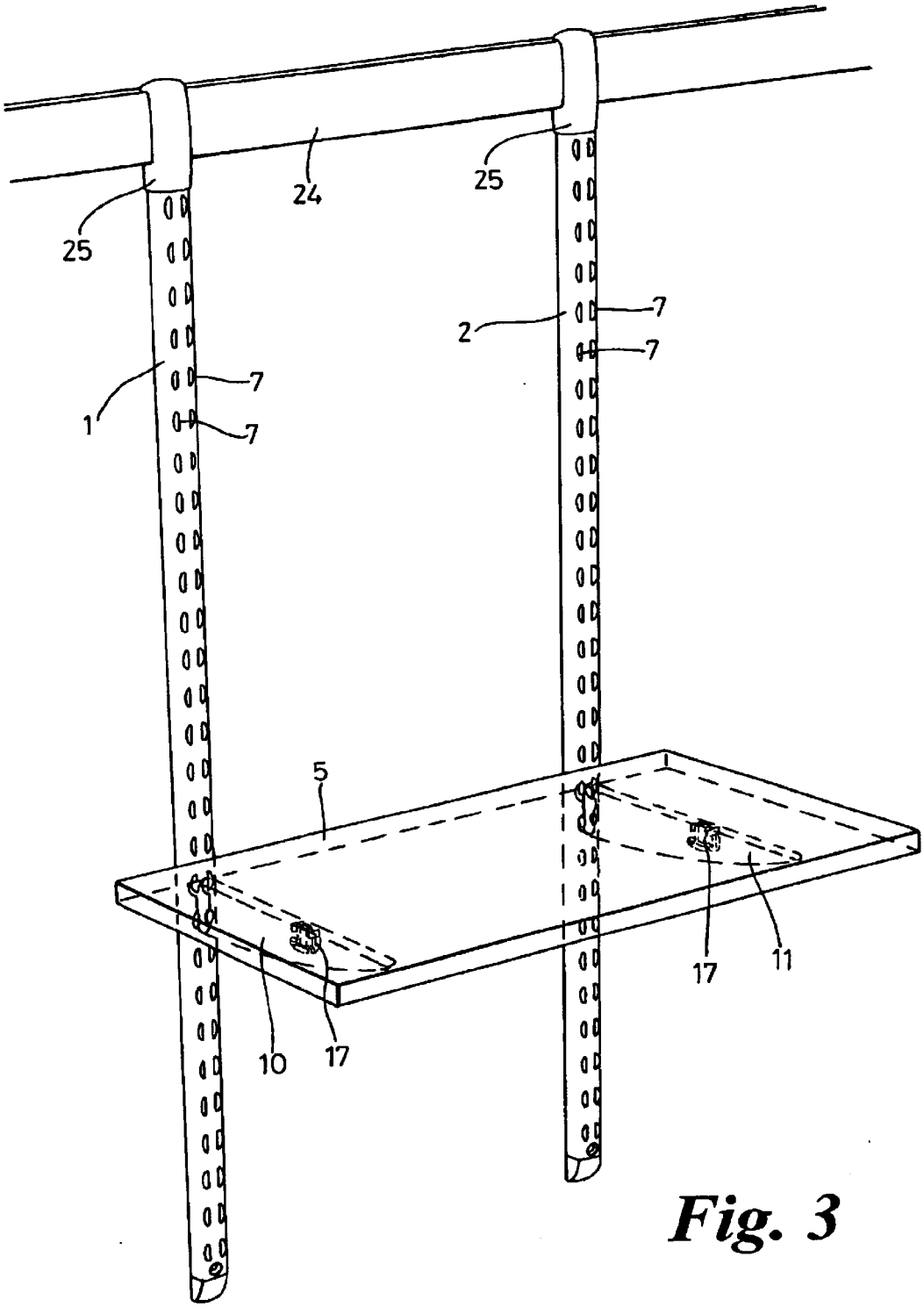
FIG. 3 illustrates a suspended shelving system in accordance with the present invention.

The shelving systems illustrated in FIGS. 2 and 3 have similar components to those of the conventional shelving system illustrated in FIG. 1 and is intended to be capable of being retrofitted to conventional shelving uprights. Hence, like reference numerals shall be used where appropriate.

The uprights 1, 2 of FIG. 2 are of U-shaped cross-section and, when mounted on a wall, define in combination with the wall an enclosed channel. Two lines of apertures 7 extending the length of each of the uprights 1, 2 again provide access to the enclosed channel. In the shelving system of FIG. 2, however, the apertures 7 are mirrored D-shaped apertures rather than lozenge-shaped. The uprights 1,2 are again attached to the wall by means of at least two apertures 6 in each upright that are adapted to receive conventional wall screws. Caps are additionally provided at each end of the uprights 1,2 to close off the ends of the uprights and to provide a more pleasing appearance. The shelves 5 (only one is illustrated in FIGS. 2 and 3) may be identical in all respects to conventional shelves and as before are preferably made of a wood or an equivalent material.

The brackets 10, 11 are similar to conventional shelving brackets in that they are of U-shaped cross-section and each side has a right-angled corner between two straight edges: the first edge 12, abutting the upright 1, 2 and the second straight edge 13 abutting the underneath of a shelf 5. The third downwardly facing edge of the bracket 14, which would be the hypotenuse on a conventional shelving bracket, describes an arc rather than a straight line so that the bracket remains deeper for a greater proportion of its length before tailing off to a point furthest from the upright. The brackets 10, 11 also include opposed pairs of L-shaped hooks 15 along the first edge 12 for attaching the brackets to the uprights 1, 2 by insertion of the hooks 15 into the slots in an upright.

Each bracket 10, 11 includes a single screw hole 8 in the downwardly facing edge 14 of the bracket and because of the pronounced arc the screw hole 8 is positioned further from the upright in comparison to conventional shelving brackets. Additionally, a pair of opposed side apertures 16 are provided, one in each side of the bracket. The side apertures 16 are illustrated as generally rectangular in shape, however, alternative shapes of aperture may equally be employed and the side apertures 16 are positioned such that a line passing through these two side apertures intersects a vertical line passing through the screw hole 8.

FIG. 3 illustrates a suspended modular shelving system which will be described in greater detail below but which fundamentally consists of an upright 1, 2 (two are illustrated in FIG. 3) hung from a crossbar 24 otherwise referred to as a suspension girder or rail. In all other respects the shelving system is identical to the one illustrated in FIG. 2.

Figure 4:
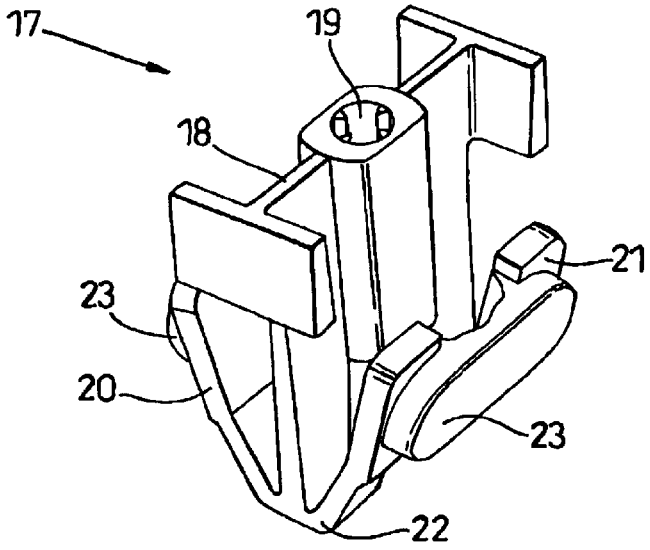
FIG. 4 illustrates the screw guide of the shelving system of FIG. 2.
Figure 5:
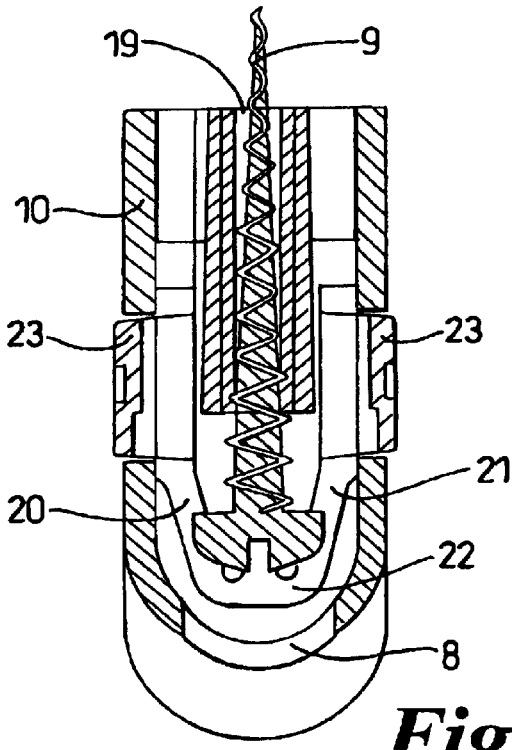
FIG. 5 is a cross-sectional drawing of the screw guide of FIG. 4.

The shelving systems illustrated in FIGS. 2 and 3 include a further component not found in existing modular shelving systems. The further component consists of a screw guide, generally indicated at 17 which may be more clearly seen in FIGS. 4 and 5. The screw guide 17 has a central wall 18 through which a screw hole 19 extends lengthways and has two outer flanges 20, 21 attached to the central wall 18 along one edge 22. The screw guide is preferably fabricated from a hard plastics material such as nylon or polypropylene that has sufficient resilience to permit a small amount of flexure of the outer flanges 20, 21 along the edge 22 relative to the central wall 18. On the outwardly facing surface of each of the two flanges 20, 21 respective lugs 23 are provided that are shaped to be inserted into and engage with the side apertures 16 of the bracket 10, 11.

In use, a screw 9 is partially screwed into the screw hole 19 in the guide 17 so that the head of the screw 9 projects downwardly from the edge 22 of the guide 17. The two flanges 20, 21 of the screw guide 17, which are naturally biased outwardly from the central wall 18, are then urged towards the central wall 18 so that the guide 17 can be inserted into the space between the two side walls of a bracket 10, 11 with the screw 9 and the edge 22 of the guide 17 leading the insertion of the guide 17 into the space between the two sides of the bracket 10, 11. Once inside the bracket the screw guide 17 is moved to its final position in which the two lugs 23 are aligned with the side apertures 16. When the screw guide 17 is in its final position, the flanges 20, 21 automatically flex away from the central wall 18 and the lugs 23 engage with the side apertures 16 thereby securely holding the screw guide 17 in position within the bracket 10, 11. Location of the lugs 23 in the side apertures 16 also ensures that the screw 9 is aligned with the screw hole 8 in the bracket 10, 11.

With the screw guide 17 in place, a screw driver may be inserted through the screw hole 8 to engage with the head of the screw 9 and thereby enable the screw to be screwed into the underside of the shelf 5. The screw hole 19 in the screw guide 17 ensures that even the very long screws required to bridge the space from the outside edge of the bracket to the underneath of the shelf are supported in the space between the sides of the bracket and are thus guided to the underside of the shelf 5. This in turn ensures that the screw 9 is screwed into the shelf 5 substantially normal to the surface of the shelf rather than at an acute angle, as can often be the case with conventional modular shelving systems.

Furthermore, if at any stage in the future it is decided to disassemble the shelving system and re-position the height of individual shelves this can be done very easily without resorting to screwing extra screw holes into the shelves. To remove the shelves, the lugs 23 projecting through the side apertures in each of the two brackets 10,11 are pressed so as to be released from the side apertures 16 in the bracket. This enables the screw guide 17 to be removed from the bracket 10,11 and enables the shelf 5, still attached to the screw guide 17, to be removed from the brackets 10, 11. The brackets can then be re-positioned as desired on the uprights and the shelf re-attached to the brackets by re-inserting the two screw guides 17 between the side walls of respective brackets until the lugs 23 once again engage in the side apertures 16 of the brackets. Thus, once attached to the underneath of the shelf the screw guide 17 preferably remains attached to the shelf 5 at all times thereby avoiding the need to re-screw the shelf to the bracket when repositioning the shelf.

Referring back to FIG. 3 The two uprights 1, 2 are each hung from the crossbar 24 by means of a coupling member, generally indicated at 25, details of which may be more clearly seen in FIGS. 6 and 7. The coupling member 25 comprises a hook body 26 at upper edge of which includes a first bead 27. The majority of the hook body 26 is generally planar although, as will be described below, the hook body 26 has a slight curvature which in the illustrated embodiment is intended to substantially follow the curvature of the front wall of the crossbar 24 but this is not essential. The upper edge region 26*a* of the hook body 26 describes a sharp curve towards the back of the hook body 26 with the upper edge region 26*a* terminating in the first bead 27 which is positioned so as to lie behind the hook body 26.

The lower edge of the hook body 26 forms a cap 28 which, in the illustrated embodiment, is sized to enclose the upper end of an upright 1, 2. The cap 28 consists of a front wall 29, two opposed side walls 30 and an end wall 31. The end wall 31 includes a threaded channel 32 which lies at an acute angle to the front wall 29 and provides passage for a grub screw 33 from the exterior of the cap 28 to the interior. The rear surface of the front wall 29 carries a pair of L-shaped hooks 34 which project into the space defined by the walls of the cap 28. The L-shaped hooks 34 are arranged for location within and engagement with a pair of slots 7 in an upright 1, 2. Above the L-shaped hooks 34, the rear surface of the front wall 29 carries a generally circular disk 35 that also projects into the space defined by the walls of the cap 28. The circular disk 35 is positioned and sized so as to engage in the screw hole 6 provided in the upper end of an upright 1, 2.

Figure 6D:
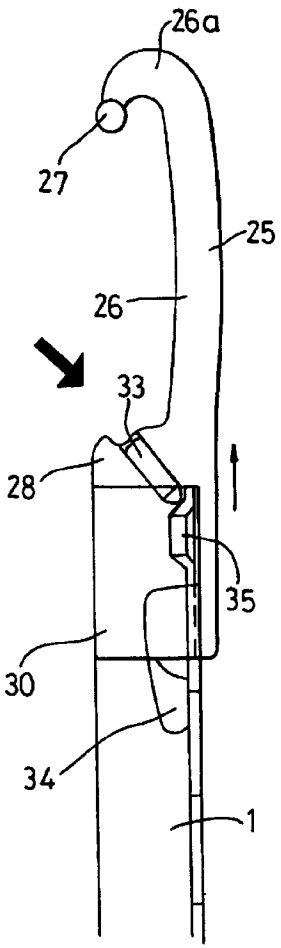
FIGS. 6*a*–6*d* illustrate the attachment of a coupling member of the suspended shelving system of the present invention to an upright.
Figure 6C:
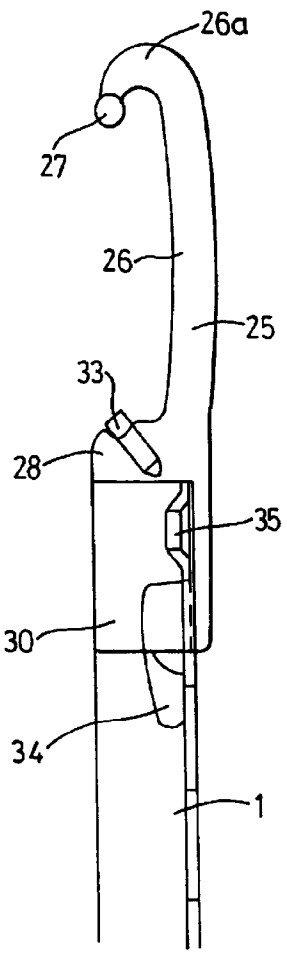
Figure 6B:
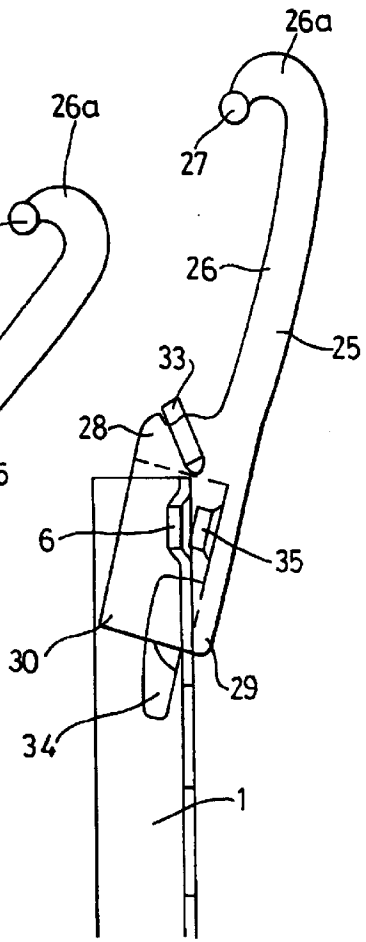
Figure 6A:
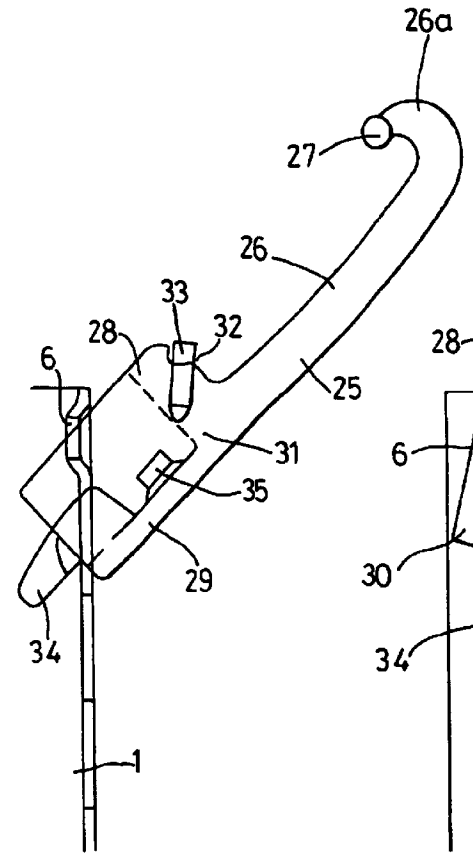
Figures 7A, 7B, 7C, 7D:
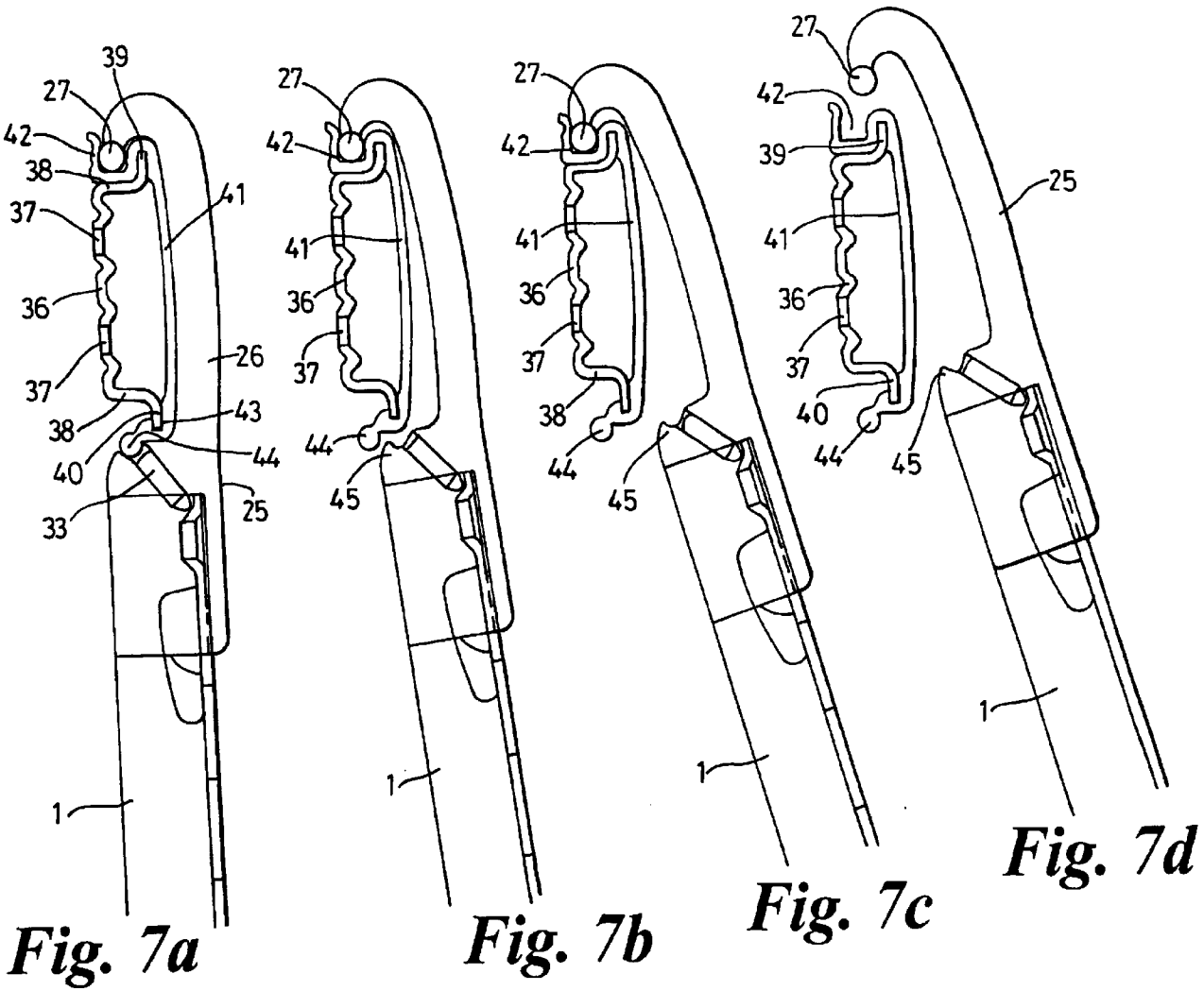
FIGS. 7*a*–7*d* illustrate the unattachment of the coupling member with an upright to the crossbar of a suspended shelving system in accordance with the present invention.

FIGS. 6*a* through 6*d* illustrate the attachment of the coupling member 25 to the upper end of an upright 1. The L-shaped hooks 34 are inserted at an angle into the first pair of slots at the top of the upright 1 immediately below the screw hole 6 in the upright. The coupling member 25 is then rotated so as to position the cap 28 over the end of the upright 1 which brings the circular disk 35 into engagement with the screw hole 6. The coupling member 25 continues to be rotated until the hook body 26 is generally aligned with the upright 1 and presents a substantially continuous surface with the front of the upright 1 with the exception of a small shoulder at the free bottom edge of the cap 28. Once in position about the end of the upright 1, as shown in FIG. 6*d*, the grub screw 33 is screwed into the threaded channel 32 until it engages with the inner surface of the front wall of the upright 1. Further rotation of the grub screw 33 thus results in the coupling member 25 being raised relative to the end of the upright thereby locking the coupling member 25 in position on the end of the upright. In one version of the coupling member 25, the grub screw 33 continues to be turned until the L-shaped hooks 34 come into contact with the upper edge of the slots 7 in the upright. With this version of the coupling member 25 the L-shaped hooks 34 are required to be longer than the slots 7 into which they are inserted.

With the coupling member 25 securely attached to the upright 1 the upright is ready for hanging from the crossbar 24. The crossbar 24 comprises a rail 36 which has a series of screw apertures 37 through which screws (not illustrated) are inserted for attaching the rail 36 to a wall. At its upper and lower longitudinal edges, the rail 36 has respective forwardly projecting walls 38 the free longitudinal edges of which terminate in rims 39, 40 that extend away from the upper and lower walls 38 respectively upwardly and downwardly. The crossbar 24 further includes a cover 41 which engages with the rims 39, 40 of the rail 36 to define an enclosed space therebetween and acts to hide the heads of the screws used to attach the rail 36 to the wall. The cover is slightly outwardly curved to present a pleasing appearance and includes a longitudinal channel 42 along its upper edge which engages between the upper rim 39 of the rail and the wall. The lower longitudinal edge of the cover 41 includes a slot 43 for receiving the lower rim 40 of the rail and beyond the slot 43 the cover has a beaded edge 44.

FIGS. 7*a* through 7*d* illustrate a coupling member 25 with an upright 1 being removed from the crossbar 24, however, it will be immediately apparent that hanging an upright from the crossbar 24 simply involves a reversal of this procedure i.e. 7*d* through to 7*a*. To attach the upright 1 to the crossbar 24 the bead 27 at the top edge of the coupling member 25 is positioned in the channel 42 of the cover 41. The coupling member 25 is then rotated towards the cover 41 until the longitudinal bead 44 of the cover 41 contacts a shoulder 45 on the coupling member 25 which is positioned adjacent the threaded channel 32. The coupling member 25 is then snap-fitted into position over the front of the cover 41 by forcing the bead 44 past the shoulder 45 on the coupling member. Once in position the upright hangs substantially vertically downwardly from the crossbar 24 and the hook body 26 of the coupling member contacts the front surface of the cover 41 and substantially follows the contours of the front surface of the cover. In addition, once past the shoulder 45, the bead 44 on the lower edge of the cover 41 overlies the opening to the threaded channel 32 thus preventing accidental escape of the grub screw 33 from the channel 32. Also, in circumstances where the coupling member has not been properly attached to the upright and in particular the grub screw has not been fully screwed into the coupling member, the projection of the grub screw from the threaded channel 32 prevents the coupling member being mounted on the cover.

This arrangement has the further advantage that when unhooking the upright 1 from the crossbar 24, the upright 1 may simply be pulled away from the wall and the action of the grub screw 33 against the inner wall of the upright 1 ensures that the coupling member remains fixedly attached to the upright and moves with the upright so as to permit the bead 44 on the cover to pass the shoulder 45 on the coupling member thereby releasing the coupling member 25 from the cover 41.

It will be apparent that the hook body 26 need not enclose the end of the upright 1, 2 and instead may simply consist of a downwardly depending wall on which the L-shaped hooks 34 are provided.

The shelving system described herein and in particular the use of an intermediate member to couple the upright to the crossbar in a suspended shelving system provides a particularly strong structure in which the attachment and removal of individual uprights is particularly simple but effective. Moreover, the shelving system is pleasing in appearance and preferably avoids any visibly protruding edges or regions where significant amounts of dust etc might collect.

Although reference has been made herein to metal modular shelving systems it will of course be immediately apparent that the features of the present invention may apply to a large range of different modular shelving systems and the present invention is not limited to shelving systems constructed using metal but extends to shelving of wood or composites of wood. Moreover, although the storage system has been described in detail with respect to shelving it will be immediately apparent that the storage system may also be used in relation to other storage elements such as but not limited to baskets, cabinets, cupboards and the like.

What we claim is:

1. A storage system comprising:

a suspension crossbar;

at least one upright having a plurality of slots arranged in lines along the length of the upright;

one or more brackets for attachment to the at least one upright; and at least one storage element for mounting on the one or more brackets, the storage system further comprising a respective coupling device for each of said at least one upright, the coupling device being adapted to hang the upright from the suspension crossbar, the coupling device comprising:

a hook body adapted for engagement with the suspension crossbar, a downwardly depending wall, a slot hook projecting from the downwardly depending wall, the slot hook being adapted for engagement in a slot in the upright, and a movable holding member arranged to engage the surface of the upright facing away from the downwardly depending wall of the coupling device.

2. A storage system as claimed in claim 1 wherein the movable holding member consists of a movable finger movable between a first engaging position where a free end of the finger is in contact with the surface of the upright facing away from the downwardly depending wall of the coupling device and a second released position where said free end of the finger is free of contact with said surface of the upright.

3. A storage system as claimed in claim 2, wherein the finger is in the form of a grub screw located and movable within a threaded channel in the coupling device.

4. A storage system as claimed in claim 1, wherein the movable holding member consists of a movable finger movable between a first engaging position where a free end of the finger is in contact with the surface of the upright facing away from the downwardly depending wall of the coupling device and a second released position where said free end of the finger is free of contact with said surface of the upright and wherein the slot hook is arranged to project rearwardly from the downwardly depending wall through a slot in the upright and the finger is arranged at an acute angle to the inner slotted surface of the upright.

5. A storage system as claimed in claim 1, wherein at least one screw hole is provided in an upper end region of said at least one upright and said coupling device further includes a lug adapted for engagement in said screw hole.

6. A storage system as claimed in claim 1, wherein the downwardly depending wall of the coupling device forms part of a downwardly depending skirt adapted to surround at least three sides of an upper end region of the upright.

7. A storage system as claimed in claim 1, wherein two parallel lines of slots are provided in the at least one upright and the coupling device has a pair of slot hooks arranged to engage a pair of adjacent slots in the upright.

8. A storage system as claimed in claim 1, wherein the crossbar and the hook body of the coupling device include a reciprocating longitudinal bead and shoulder whereby the hook body is a snap-fit over the crossbar.

9. A coupling device for use in a suspended storage system comprising a crossbar, at least one upright, at least one bracket and at least one storage element, the coupling device comprising:

a hook body adapted for engagement with the crossbar of the storage system, a downwardly depending wall, a slot hook projecting from said downwardly depending wall, said slot hook being adapted for engagement in a slot in an upright of the storage system, and a movable holding member movable towards and away from the surface of the downwardly depending wall from which the slot hook projects;

wherein the movable holding member consists of a finger movable between a first engaging position where a free end of the finger contacts with the surface of the upright facing away from the downwardly depending wall of the coupling device and a second released position where said free end of the finger is free of contact with said surface of the upright.

10. A coupling device as claimed in claim 9, wherein the finger is in the form of a grub screw located and movable within a threaded channel in the coupling device.

11. A coupling device as claimed in claim 9, wherein the slot hook is arranged to project rearwardly from the downwardly depending wall and the finger is arranged at an acute angle to the downwardly depending wall.

12. A coupling device as claimed in claim 9, comprising a pair of slot hooks arranged to engage a pair of adjacent slots in an upright of the storage system.

13. A coupling device for use in a suspended storage system comprising a crossbar, at least one upright, at least one bracket and at least one storage element, the coupling device comprising:

a hook body adapted for engagement with the crossbar of the storage system, a downwardly depending wall, a slot hook projecting from said downwardly depending wall, said slot hook being adapted for engagement in a slot in an upright of the storage system, a movable holding member movable towards and away from the surface of the downwardly depending wall from which the slot hook projects; and a lug adapted for engagement in a screw hole in an upright of the storage system.

14. A coupling device for use in a suspended storage system comprising a crossbar, at least one upright, at least one bracket and at least one storage element, the coupling device comprising:

a hook body adapted for engagement with the crossbar of the storage system, a downwardly depending wall, a slot hook projecting from said downwardly depending wall, said slot hook being adapted for engagement in a slot in an upright of the storage system; and a movable holding member movable towards and away from the surface of the downwardly depending wall from which the slot hook projects;

wherein the downwardly depending wall forms part of a downwardly depending skirt adapted to surround at least three sides of an upper end region of an upright of the storage system.

* * * * *